US008622597B2

(12) United States Patent
Tseng

(10) Patent No.: US 8,622,597 B2
(45) Date of Patent: Jan. 7, 2014

(54) VEHICLE LIGHTING DEVICE

(75) Inventor: Kuo-Fong Tseng, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/597,288

(22) Filed: Aug. 29, 2012

(65) Prior Publication Data

US 2013/0215634 A1 Aug. 22, 2013

(30) Foreign Application Priority Data

Feb. 20, 2012 (TW) ..... 101105385 A

(51) Int. Cl.

| | |
|---|---|
| ***F21V 7/00*** | (2006.01) |
| ***F21S 8/10*** | (2006.01) |
| ***F21V 14/02*** | (2006.01) |
| ***F21V 19/02*** | (2006.01) |

(52) U.S. Cl.

USPC ..... 362/517; 362/518; 362/515; 362/523

(58) Field of Classification Search

USPC ..... 362/515, 517, 518, 523

See application file for complete search history.

(56) References Cited

U.S. PATENT DOCUMENTS

| | | | | |
|---|---|---|---|---|
| 6,334,702 | B1 * | 1/2002 | Albou | 362/514 |
| 6,341,884 | B1 * | 1/2002 | Leleve et al. | 362/514 |
| 7,275,846 | B2 * | 10/2007 | Browne et al. | 362/512 |
| 7,883,250 | B2 * | 2/2011 | Nishihata | 362/516 |
| 7,918,595 | B2 * | 4/2011 | Albou | 362/518 |
| 7,972,046 | B2 * | 7/2011 | Iwasaki | 362/517 |
| 2003/0231510 | A1 * | 12/2003 | Tawa et al. | 362/528 |
| 2005/0248955 | A1 * | 11/2005 | Nishizawa et al. | 362/514 |
| 2007/0236951 | A1 * | 10/2007 | Albou | 362/507 |
| 2007/0268717 | A1 * | 11/2007 | Iwasaki | 362/539 |
| 2008/0225540 | A1 * | 9/2008 | Tsukamoto et al. | 362/514 |
| 2010/0072511 | A1 * | 3/2010 | Lin et al. | 257/99 |
| 2011/0211361 | A1 * | 9/2011 | Kawamura | 362/516 |

* cited by examiner

*Primary Examiner* — David J Makiya

(74) *Attorney, Agent, or Firm* — Altis Law Group, Inc.

(57) ABSTRACT

A vehicle lighting device includes a body, a light source and a reflecting module. The body defines an outputting opening. The light source includes an LED. The reflecting module includes a first reflector, a second reflector and a third reflector. One part of light incident to the first reflector is firstly reflected by the first reflector, secondly reflected by the second reflector, thirdly reflected by the third reflector, and finally travels out of the body via the outputting opening. Another part of the light incident to the first reflector is firstly reflected by the first reflector, secondly reflected by the third reflector, and finally travels out of the body via the outputting opening. The rest part of the light is incident to the third reflector and then is reflected by the third reflector to travel out of the body via the outputting opening.

18 Claims, 2 Drawing Sheets

VEHICLE LIGHTING DEVICE

BACKGROUND

1. Technical Field

The present disclosure generally relates to vehicle lighting devices, and particularly to a vehicle lighting device having a plurality of reflecting surfaces.

2. Description of Related Art

In recent years, due to excellent light quality and high luminous efficiency, light emitting diodes (LEDs) have increasingly been used as substitutes for incandescent bulbs, compact fluorescent lamps and fluorescent tubes as light sources of illumination devices.

A common vehicle lighting device usually includes a central light source and a reflector surrounding the central light source. The central light source is used for radiating light. The reflector is used for limiting the light along a predetermined outputting direction, thereby achieving a high light illumination. However, in this condition, only about thirty percent of the light radiated from the central light source can be reflected and adjusted by the reflector for effective utilization. The other seventy percent of the light will be output directly, without being reflected or adjusted by the reflector. As such, part of the seventy percent of the light will not travel along the predetermined direction, and be not available for utilization to enhance a light illumination thereof. As such, a luminous flux of the light of the common vehicle lighting device employing a light emitting diode (LED) as the central light source in a predetermined outputting area usually can not achieve the rules cause of low utilization of light.

Therefore, what is needed is to provide a vehicle lighting device which can overcome the above shortcomings.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

DETAILED DESCRIPTION

Reference will now be made to the drawings to describe the vehicle lighting device, in detail.

Figure 1:
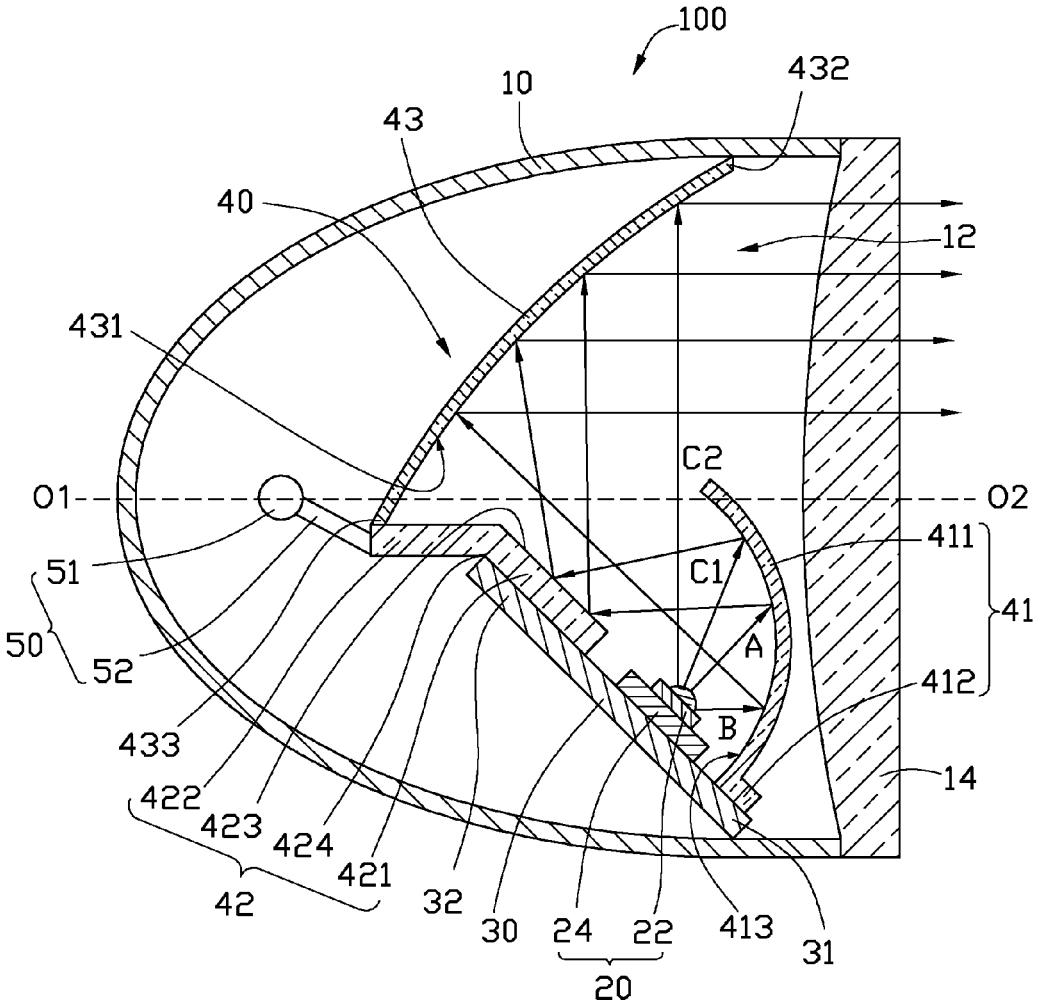
FIG. 1 is a schematic, cross-sectional view of a vehicle lighting device in accordance with an exemplary embodiment of the present disclosure.

Referring to FIG. 1, a vehicle lighting device 100 of an exemplary embodiment is provided. The vehicle lighting device 100 includes a body 10, a light source 20, a supporting board 30 and a reflector module 40.

The body 10 is used for receiving the light source 20, the supporting board 30 and the reflector module 40. The body 10 is substantially bowl-shaped. Light radiated from the light source 20 can travel out of the body 10 via part of an opening thereof. This part of the opening of the body 10 acts as a light outputting opening 12. A circuit control module (not illustrated) can be further employed in the body 10 to supply power for the light source 20. A lens 14 is fixed at the opening of the body to envelope the body 10. The light radiated from the light source 20 will be firstly reflected by the reflecting module 40, and then travels out of the lens 14 via the outputting opening 12.

The light source 20 includes an LED 22 and a base 24 supporting the LED 22. The LED 22 is arranged on the base 24 and electrically connected to the base 24. A surface of the base 24 supporting the LED 22 is plated with copper by semiconductor process. The base 24 plated with copper can decrease an error of the base 24, thereby improving an assembly accuracy of the light source 20 to increase an efficiency of light distribution control. Further, the base 24 plated with copper has better thermal conductivity than a conventional base made of ceramic material. Thus, the base 24 can increase heat dissipation efficiency of the vehicle lighting device 100.

The supporting board 30 is substantially a plate like structure. The supporting board 30 is inclined to a central axis $O_1O_2$ of the vehicle lighting device 100 without intersecting the central axis $O_1O_2$. The supporting board 30 includes an outer distal end 31 and an inner distal end 32. The outer distal end 31 is remote from the central axis $O_1O_2$ and abuts against an inner surface of the body 10, near the lens 14 in the opening of the body 10. The inner distal end 32 is adjacent to the central axis $O_1O_2$ of the vehicle lighting device 100, remaining a distance therebetween. The light source 20 is mounted on the supporting board 30. The base 24 is fixed on the supporting board 30 with the light source 20 facing the lens 14. The supporting board 30 can be made of materials with light reflecting ability, such as aluminum and ceramic, to assist the reflecting module 40 in reflecting light.

The reflecting module 40 includes a first reflector 41, a second reflector 42, and a third reflector 43. One part of light incident to the first reflector 41 is firstly reflected by the first reflector 41, secondly reflected by the second reflector 42, thirdly reflected by the third reflector 43, and finally travels out of the body 10 via the outputting opening 12. Another part of the light incident to the first reflector 41 is firstly reflected by the first reflector 41, secondly reflected by the third reflector 43, and finally travels out of the body 10 via the outputting opening 12. The rest part of the light is incident to the third reflector 43 and then reflected by the third reflector 43 to travel out of the body 10 via the outputting opening 12.

The first reflector 41 is positioned adjacent to the lens 14. The first reflector 41 includes a holder 412, a curved portion 411, and a reflecting surface 413. The reflecting surface 413 faces away from the lens 14. In other words, the reflecting surface 413 faces the light source 20 away from a direction of the light output from the outputting opening 12 of the body 10. The holder 412 is positioned at an end of the curved portion 411 and is fixed to the outer distal end 31 of the supporting board 30, thereby connecting the first reflector 41 to the supporting board 30. The curved portion 411 is positioned above the light source 20 and protrudes towards a direction along the light radiated from the light source 20. The reflecting surface 413 is substantially a curved reflecting surface. The reflecting surface 413 can be made up of a free curved surface with parabola, a deformed parabola, a deformed ellipsoid, or a combination thereof. The curved portion 411 faces the light source 20 to reflect the light radiated from the light source 20 towards an opposite direction. Taking an example, light A is a light beam radiated from the light source 20 along a direction collinear with an optical axis of the LED 22. Light B is a light beam radiated from the light source 20 along a direction inclined towards a right side of the optical axis of the LED 22. Light C1 is a light beam radiated from the light source 20 along a direction inclined towards a left side of the optical axis of the LED 22. Light C2 is a light beam radiated from the light source 20 along a direction inclined towards the far left of the optical axis of the LED 22. The light A, B, C1 can be incident to the first reflector 41 and be reflected by the first reflector 41 firstly. The light C2 can not be incident to the first reflector 41, but is incident to the third reflector 43 directly. The fact that light radiated from the light source 20 along a direction inclined towards the left of an optical axis of the LED 22 can be incident to the first reflector 41 or the third reflector 43, depends on a curvature radius and an area of the first reflector 41. More light will incident to the first reflector 41 when the curvature radius and/or the area of the first reflector 41 is adjusted to meet different actual requirements.

The second reflector 42 is positioned in a central portion of the vehicle lighting device 100 and fixed at the inner distal end 32 of the supporting board 30 away from the holder 412 of the first reflector 41. In other words, the first reflector 41 and the second reflector 42 are positioned on two different ends of the supporting board 30, respectively. The second reflector 42 substantially faces the first reflector 41. The second reflector 42 includes a first portion 421, a second portion 422 and a reflecting surface 423. The first portion 421 and the second portion 422 are both with plate like structures. The second portion 422 is parallel to the central axis $O_1O_2$ of the vehicle lighting device 100, and away from the first reflector 41. The first portion 421 is parallel to the supporting board 30 and stacked on the supporting board 30 firmly, adjacent to the light source 20. The first portion 421 intersects the second portion 422 with an angle therebetween. A corner 424 interconnects the first portion 421 and the second portion 422. The inner distal end 32 abuts against the corner 424. The reflecting surface 423 is formed on the first portion 421. The reflecting surface 423 is used for reflecting part of the light from the first reflector 41 for the second time. The second portion 422 is used for connecting the third reflector 43. The light A and C1 incident upon the first reflector 41 can be firstly reflected to the second reflector 42 and then be reflected to the first portion 421.

The third reflector 43 has a curved surface which can be made up of free curved surfaces with an ellipsoid, a deformed ellipsoid, a deformed parabola or a combination thereof. The third reflector 43 protrudes away from the outputting opening 12 of the vehicle lighting device 100. The third reflector 43 includes a reflecting surface 431, a top end 432, and a bottom end 433. The reflecting surface 431 of the third reflector 43 faces the outputting opening 12. The top end 432 and the bottom end 433 are positioned at two ends of the reflecting surface 431. The top end 432 abuts against the inner surface of the body 10, opposite to the outer distal end 31 of the supporting board 30. The bottom end 433 is connected to the second portion 422 of the second reflector 42. All the light will be incident to and be reflected by the third reflector 43, and then travel out of the body 10 via the outputting opening 12 as concentrated parallel light.

Each of the first, second, third reflector 41, 42, 43 substantially faces the others. Light radiated from the light source 20 can be reflected among the three reflectors and finally travels out of the body 10 via the outputting opening 12. The third reflector 43 is inclined to the central axis $O_1O_2$ of the vehicle lighting device 100. An angle is formed between the third reflector 43 and the second reflector 42. In other embodiments, the supporting board 30 can be made of the same material as the reflecting module 40 to act as a total reflecting surface together with the reflecting module 40. Thus, all light radiated from the light source 20 will be reflected by the reflecting module 40 and the supporting board 30 to improve a reflective efficiency of the vehicle lighting device 100, without missing any light in different angle.

The light A and C1 radiated from the light source 20 will be reflected three times. The light A and C1 incident to the first reflector 41 is reflected by the first reflector 41, reaching the second reflector 42, reflected by the second reflector 42, reaching the third reflector 43, reflected by the third reflector 43, and travels out of the body 10 via the outputting opening 12 of the vehicle lighting device 100 in sequence. The light B radiated from the light source 20 will be reflected two times. The light B incident to the first reflector 41 is reflected by the first reflector 41, reaching the third reflector 43, reflected by the third reflector 43, and travels out of the body 10 via the outputting opening 12 of the vehicle lighting device 100 in sequence. The light C1 radiated from the light source 20 will be reflected one time. The light C1 incident to the third reflector 43 is reflected by the third reflector 43, and travels out of the body 10 via the outputting opening 12 of the vehicle lighting device 100. All the light radiated from the light source 20 towards different directions, such as the light A, B, C1 and C2, will finally be reflected by the third reflector 43 to travel out of the body 10 via the outputting opening 12. All the light will be controlled and adjusted by the third reflector 43 to obtain concentrated parallel light in a predetermined outputting direction with small dispersion angles. Light traveling along disordered directions of the conventional vehicle lighting device will be concentrated for utilization after the light radiated from the light source 20 is reflected at least one time. A luminous flux of the light in the predetermined area of the present vehicle lighting device 100 increases. Furthermore, an amount of the LEDs employed in the vehicle lighting device 100 will decrease, and an operating current supplying to the light source 20 will decrease.

Figure 2:
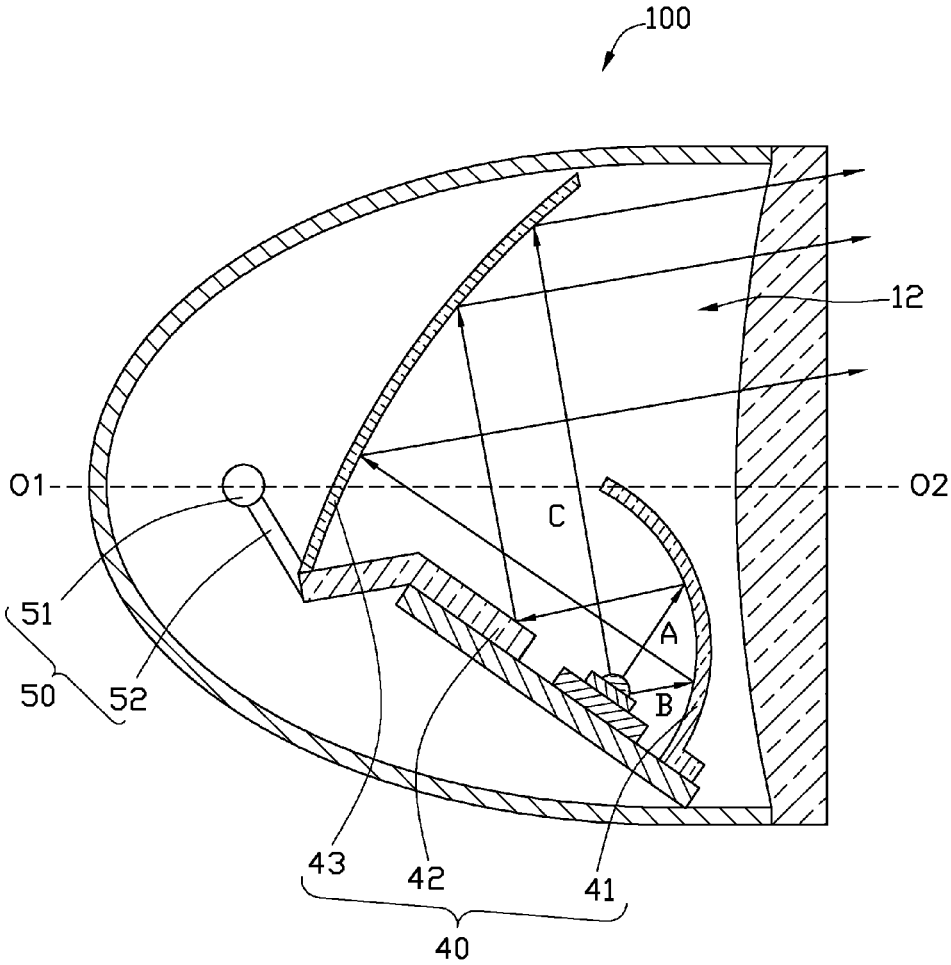
FIG. 2 is a schematic, cross-sectional view of the vehicle lighting device of FIG. 1, wherein reflectors of the vehicle lighting device rotates an angle.

The present vehicle lighting device 100 further includes a rotating portion 50. The rotating portion 50 is positioned in the body 100 away from the outputting opening 12. The rotating portion 50 includes a rotation center 51 and a stretching connector 52. The stretching connector 52 can rotate around the rotation center 51 and stretch along a lengthwise direction thereof. An end of the stretching connector 52 is rotatably connected to the rotation center 51. The other end of the stretching connector 52 is connected to the reflecting module 40. The rotation center 51 is positioned on the central axis $O_1O_2$ of the vehicle lighting device 100. The stretching connector 52 is connected to the second portion 422 of the second reflector 42. Accordingly, the reflecting module 40 is capable of rotating around the rotation center 51 and stretching in relative to the rotation center 51, when driven by the stretching connector 52, thereby adjusting an angle of the light traveling out of the body 10 via the outputting opening 12, shown as FIG. 2.

In this present disclosure, the reflecting module 40 includes three reflectors to reflect light radiated from various directions. The light radiated from various directions can be finally reflected by the third reflector 43 for utilization. The luminous flux of the light in the predetermined area of the present vehicle lighting device 100 increases. Further, the number of the LEDs employed in the vehicle lighting device 100 will decrease. The operating current supplying to the light source 20 will decrease. The reflecting module 40 is capable of rotating around the rotation center 51, thereby adjusting an angle of the light traveling out of the body 10 to meet different actual requirements.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A vehicle lighting device, comprising:

a body defining an outputting opening;

a light source received in the body, the light source comprising an LED (light emitting diode), light radiated from the light source traveling out of the body via the outputting opening;

a reflecting module, comprising:

a first reflector with a reflecting surface facing away from the outputting opening;

a second reflector with a reflecting surface facing the outputting opening;

a third reflector with a reflecting surface facing the outputting opening;

wherein one part of light incident to the first reflector is firstly reflected by the first reflector, secondly reflected by the second reflector, thirdly reflected by the third reflector, and finally travels out of the body via the outputting opening, another part of the light incident to the first reflector is firstly reflected by the first reflector, secondly reflected by the third reflector, and finally travels out of the body via the outputting opening, the rest part of the light reaches the third reflector and then be reflected by the third reflector to travel out of the body via the outputting opening; and a rotating portion comprising a rotation center and a stretching connector rotatably connecting the reflecting module with the rotation center, the stretching connector being stretchable along a lengthwise direction thereof.

2. The vehicle lighting device of claim 1, wherein the reflecting surface of the first reflector faces the LED and has a curved surface which protrudes towards a direction of the light radiated from the LED.

3. The vehicle lighting device of claim 2, wherein the reflecting surface of the second reflector faces the reflecting surface of the first reflector, and the second reflector reflects light radiated from the first reflector.

4. The vehicle lighting device of claim 3, wherein the second reflector comprises a first portion and a second portion, the reflecting surface of the second reflector is formed on the first portion, the first portion and the second portion are plate-shaped, the first portion faces the first reflector, and the second portion is connected to the third reflector.

5. The vehicle lighting device of claim 4, wherein the first portion intersects the second portion with an angle therebetween.

6. The vehicle lighting device of claim 1, wherein the third reflector has a curved surface which protrudes away from the outputting opening of the vehicle lighting device.

7. The vehicle lighting device of claim 1, wherein the third reflector comprises a top end and a bottom end, the top end abuts against an inner side of the body, and the bottom end is connected to the second reflector.

8. The vehicle lighting device of claim 7 further comprising a supporting board supporting the light source, wherein the supporting board comprises an outer distal end and an inner distal end, the outer distal end abuts against an inner side of the body opposite to the top end of the third reflector, and the inner distal end is connected to the second reflector.

9. The vehicle lighting device of claim 4 further comprising a supporting board supporting the light source, wherein the supporting board comprises an outer distal end and an inner distal end, the outer distal end abuts against an inner side of the body adjacent to the outputting opening of the vehicle, and the inner distal end is connected to a corner between the first portion and the second portion of the second reflector.

10. The vehicle lighting device of claim 1, wherein the light source further comprises a base supporting the LED, the base is copper plated, and the LED is arranged on the base and electrically connected to the base.

11. The vehicle lighting device of claim 4, wherein the rotating portion is positioned in the body away from the outputting opening.

12. A vehicle lighting device, comprising:

a body defining an outputting opening;

a light source received in the body, the light source comprising an LED, light radiated from the light source traveling out of the body via the outputting opening;

a reflecting module, comprising a first reflector, a second reflector and a third reflector;

wherein one part of light incident to the first reflector is firstly reflected by the first reflector, secondly reflected by the second reflector, thirdly reflected by the third reflector, and finally travels out of the body via the outputting opening, another part of the light incident to the first reflector is firstly reflected by the first reflector, secondly reflected by the third reflector, and finally travels out of the body via the outputting opening, the rest part of the light reaches the third reflector and then be reflected by the third reflector to travel out of the body via the outputting opening; and a rotating portion comprising a rotation center and a stretching connector rotatably connecting the reflecting module with the rotation center, the stretching connector being stretchable along a lengthwise direction thereof.

13. The vehicle lighting device of claim 12, wherein a reflecting surface of the first reflector faces away from the outputting opening, the first reflector, the second reflector and the third reflector face each other, and the LED faces the first reflector and are positioned among the first reflector, the second reflector and the third reflector.

14. The vehicle lighting device of claim 13, wherein the reflecting surface of the first reflector faces the LED and has a curved surface which protrudes towards a direction of the light radiated from the LED.

15. The vehicle lighting device of claim 14, wherein the second reflector comprises a first portion and a second portion, and the first portion intersects the second portion with an angle therebetween.

16. The vehicle lighting device of claim 15, wherein the third reflector has a curved surface which protrudes away from the outputting opening of the vehicle lighting device.

17. The vehicle lighting device of claim 1, wherein the rotation center is located on a central axis of the vehicle lighting device.

18. The vehicle lighting device of claim 12, wherein the rotation center is located on a central axis of the vehicle lighting device.

* * * * *